United States Patent [19]

Orii

[11] Patent Number: 4,564,332

[45] Date of Patent: Jan. 14, 1986

[54] APPARATUS FOR TRANSFERRING A BLANK

[75] Inventor: Masaru Orii, Machida, Japan

[73] Assignee: Yugengaisha Kyodogiken, Tokyo, Japan

[21] Appl. No.: 595,820

[22] Filed: Apr. 2, 1984

[30] Foreign Application Priority Data

Apr. 25, 1983 [JP] Japan ..... 58-71532
Apr. 30, 1983 [JP] Japan ..... 58-76585

[51] Int. Cl.[4] ..... B21B 41/06

[52] U.S. Cl. ..... 414/759; 100/207; 198/403; 414/763; 414/771; 414/774

[58] Field of Search ..... 100/207; 198/403; 414/759, 763, 764, 771, 774, 761, 783

[56] References Cited

U.S. PATENT DOCUMENTS 1,519,248 12/1924 Fox ..... 414/759 X
3,400,835 9/1968 Rhoads ..... 414/774
4,125,072 11/1978 Maier et al. ..... 100/207

FOREIGN PATENT DOCUMENTS 1168830 4/1964 Fed. Rep. of Germany ..... 414/759
2431902 2/1980 France .
93767 8/1976 Japan ..... 414/759
2099403 12/1982 United Kingdom .

*Primary Examiner*—Robert J. Spar
*Assistant Examiner*—Janice Krizek
*Attorney, Agent, or Firm*—Collard, Roe & Galgano

[57] ABSTRACT

An apparatus for transferring a blank having a first blank-retaining member for retaining a blank before turnover; a second blank-retaining member for receiving the blank from the first blank-retaining member, the second blank-retaining member having its inner end rotatably linked to the inner end of said first blank-retaining member; first and second horizontally moving members adapted to be movable only in the horizontal direction and rotatably supporting the outer ends of the first and second blank-retaining members, respectively; and a driving force transmitting means which maintains the first and second blank-retaining members in their respective horizontal positions in their inoperative states but draws down the linked inner ends of the first and second blank-retaining members in their operative states so that the first and second blank-retaining members come in contact with each other at their respective vertical positions and then returns said first and second blank-retaining members to their respective horizontal positions. Moreover, the first and second horizontally moving members are provided with moving jigs, respectively, thereby allowing the blank to be moved without being turned over.

13 Claims, 21 Drawing Figures

APPARATUS FOR TRANSFERRING A BLANK

BACKGROUND OF THE INVENTION

1. Field of the Invention

The present invention relates to a blank transferring apparatus best suitable for transferring a blank under the secondary pressing operation to a subsequent pressing step while turning over the same 180 degrees, or transferring such a blank to a subsequent pressing step through the changeover between the operation in which the blank is transferred while being turned over (referred to as "turnover transfer operation", hereinafter) and the operation in which the blank is transferred without being turned over (referred to as "non-turnover transfer operation", hereinafter).

2. Description of the Prior Art

In a typical conventional turnover apparatus of this kind, a retainer member for retaining a blank turns over a blank by a 180-degree rotation and then returns to the former position by a 180-degree reverse rotation. Therefore, the retainer member is required to rotate 360 degrees for one turnover operation; hence, the turnover speed is low. In addition, the blank taken out from a press by means of the arm of a handling device is supplied into the blank turnover apparatus while being lowered from the upper side and is then turned over by the retainer member upwardly with an end edge of the blank as an axis of rotation or with the center of the blank as an axis of rotation. Therefore, the turnover operation must be started after the arm of the handling device has escaped from the upper side of the blank turnover apparatus, which hinders any reduction in time for feeding the blank from the press in the previous step to the press in the subsequent step.

In the secondary pressing operation line, a conveyor or other transfer apparatus is usually employed in the case where there is a distance between the handling terminating point of the blank taken out from the press in the previous step by means of the handling device and the feed starting point of the blank to be fed to the press in the subsequent step by means of a feeder. Moreover, in the case where it is necessary to transfer the blank while turning over the same 180 degrees, a turnover apparatus is employed.

Accordingly, it is a conventional practice that when the blank is transferred as it is, i.e., without being turned over, an ordinary transfer apparatus is installed in the secondary pressing operation line; and when the blank is transferred while being turned over, the ordinary transfer apparatus is replaced with a turnover apparatus. In consequence, when the turnover transfer operation and the non-turnover transfer operation are frequently changed over from one to the other in one secondary pressing operation line, it is troublesome to effect the operation of replacing the transfer apparatuses with each other, and in addition, much time is required therefor, disadvantageously.

SUMMARY OF THE INVENTION

Accordingly, it is a first object of the invention to provide a blank transfer apparatus which makes it possible to increase the turnover speed and start the turnover operation before the arm of the other device has escaped from the upper side of the blank transfer apparatus.

It is a second object of the invention to provide a blank transfer apparatus which makes it possible to easily change the turnover transfer operation and the non-turnover transfer operation from one to the other simply by changing jigs.

To these ends, according to one aspect of the invention, there is provided an apparatus for transferring a blank comprising: a first blank-retaining member for retaining a blank before turnover; a second blank-retaining member for receiving the blank from the first blank-retaining member, the second blank-retaining member having its inner end rotatably linked to the inner end of the first blank-retaining member; first and second horizontally moving members adapted to be movable only in the horizontal direction and rotatably supporting the outer ends of the first and second blank-retaining members, respectively; a driving force transmitting means which maintains the first and second blank-retaining members in their respective horizontal positions in their inoperative states but draws down the linked inner ends of the first and second blank-retaining members in their operative states so that the first and second blank-retaining members come in contact with each other at their respective vertical positions and then returns the first and second blank-retaining members to their respective horizontal positions; a first suction retainer which retains the blank on the first blank-retaining member from its horizontal position to its vertical position and releases the blank at the vertical position of the first blank-retaining member, the first suction retainer being mounted on the first blank-retaining member; and a second suction retainer which retains the blank on the second blank-retaining member from its vertical position to its horizontal position and releases the blank at the horizontal position of the second blank-retaining member, the second suction retainer being mounted on the second blank-retaining member, whereby the blank is turned over 180 degrees through the 90-degree downward pivoting and 90-degree reverse pivoting of the first and second blank-retaining members and the delivery of the blank from the first blank-retaining member to the second blank-retaining member at their respective vertical positions. Accordingly, the turnover speed is increased, and it is possible to start the turnover operation before the arm of other device has escaped from the upper side of the blank transfer apparatus.

Moreover, according to another aspect of the invention, there is provided an apparatus for transferring a blank comprising: a first pivoting arm; a second pivoting arm having its inner end rotatably linked to the inner end of the first pivoting arm; first and second horizontally moving members adapted to be movable only in the horizontal direction and rotably supporting the outer ends of the first and second pivoting arms, respectively; two turnover jigs detachably mounted on the first and second pivoting arms, respectively; two moving jigs detachably mounted on the first and second horizontally moving members, respectively; a suction retainer mounted on each of the jigs for retaining a blank on the corresponding jig through suction; and a driving force transmitting means which maintains the first and second pivoting arms at their respective horizontal positions in their inoperative states but draws down the linked inner ends of the first and second pivoting arms in their operative states to a delivery position where the blank is transferred from one of the jigs to the other jig and then returns the first and second pivoting arms to their respective horizontal positions, whereby in the turnover transfer operation the turnover jigs are employed to transfer the blank while turning over the same 180 degrees through the 90-degree downward pivoting and 90-degree reverse pivoting of the first and second pivoting arms and the delivery of the blank from one of the turnover jigs to the other turnover jig at their respective vertical positions, and in the non-turnover transfer operation the moving jigs are employed to move the blank through the downward pivoting and reverse pivoting of the first and second pivoting arms by a predetermined angle smaller than 90 degrees and the delivery of the blank from one of the moving jigs to the other moving jig at their respective approaching positions. Accordingly, the non-turnover transfer operation and the turnover transfer operation can be easily changed over from one to the other simply by changing the jigs.

DETAILED DESCRIPTION OF THE PREFERRED EMBODIMENTS

Figure 1:
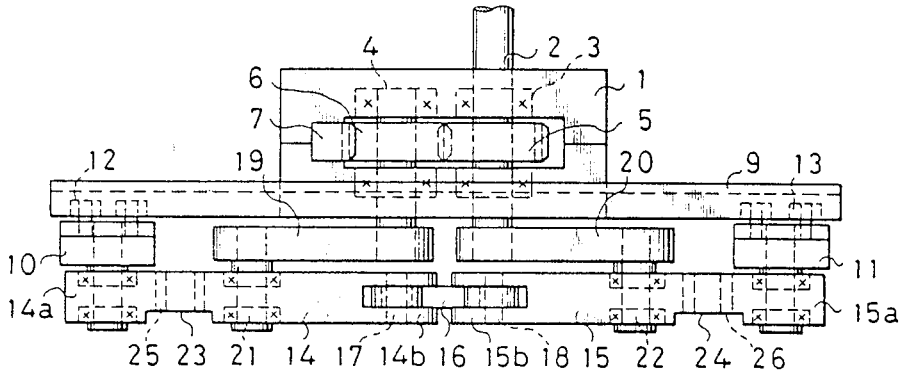
FIG. 1 is a plan view of a first embodiment of the invention in the state where turnover jigs thereof are removed.
Figure 2:
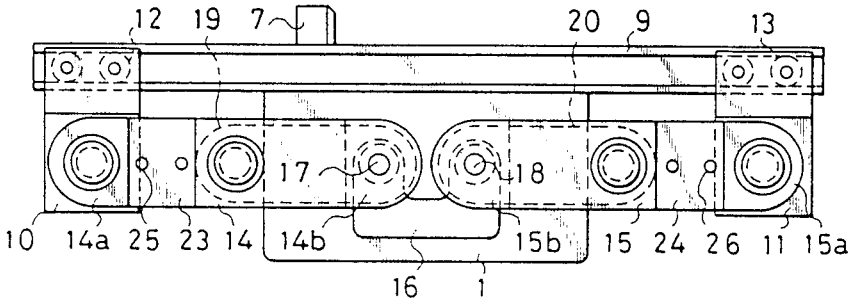
FIG. 2 is a front view of the embodiment shown in FIG. 1.
Figure 3:
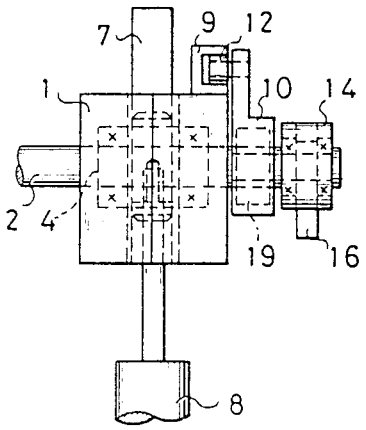
FIG. 3 is a side view of the embodiment shown in FIG. 1.

FIGS. 1 to 3 show a first embodiment of the invention in the state where turnover jigs thereof for retaining a blank are removed. A body 1 is secured to a bolster or other member of a press. A driving shaft 2 connected to a power source, such as a crankshaft of the press, is rotatably supported by a bearing 3 inside the body 1 and has its rear end projected from the body 1. A driven shaft 4 is provided in parallel to the driving shaft 2. A driving force is transmitted from the driving shaft 2 to the driven shaft 4 through gears 5, 6. The gear 6 is engaged with a rack gear 7, which is connected to the rod of an air cylinder 8. The air cylinder 8 serves as a return spring.

The body 1 has a horizontal guide rail 9 secured thereto. The guide rail 9 has a first horizontally moving member 10 and second horizontally moving member 11 which are mounted thereon through rollers 12, 13 respectively. Thus, the first and second horizontally moving members 10, 11 are movably guided only in the horizontal direction. The first horizontally moving member 10 rotatably supports the outer end **14*a* of a first pivoting arm 14. Similarly, the second horizontally moving member 11 rotatably supports the outer end 15*a* of a second pivoting arm 15. The inner end 14*b* of the first pivoting arm 14 and the inner end 15*b* of the second pivoting arm 15 are rotatably linked through a link 16 and pins 17, 18**.

The inner ends of links 19, 20 are secured to the ends of the driven shaft 4 and the driving shaft 2 forwardly projecting from the body 1, respectively. Pins 21, 22 are secured to the outer ends of the links 19, 20, respectively. The pin 21 is rotatably connected to the central part of the first pivoting arm 14, while the pin 22 is rotatably connected to the central part of the second pivoting arm 15. The first and second pivoting arms 14, 15 are provided with recesses 23, 24 for mounting turnover jigs (described hereinafter), respectively. The recesses 23, 24 have threaded holes 25, 26, respectively.

Figure 4:
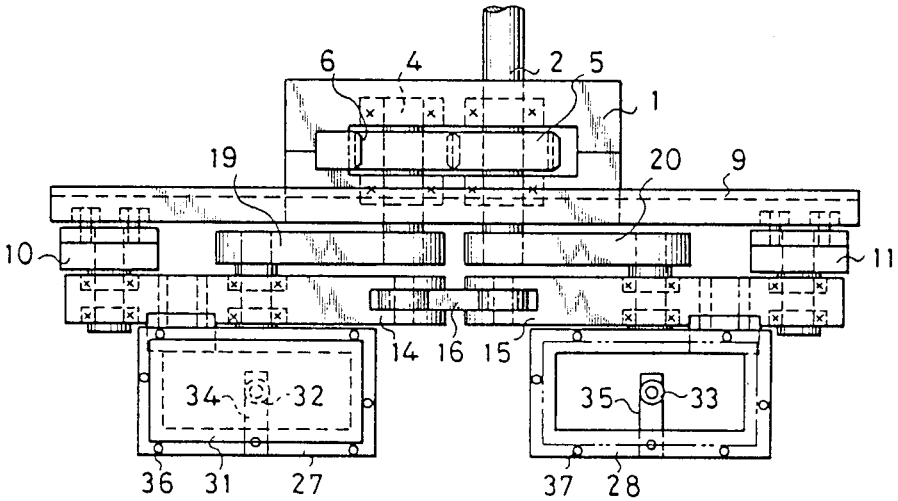
FIG. 4 is a plan view of the first embodiment of the invention in the state where the turnover jigs are mounted thereon.
Figure 5:
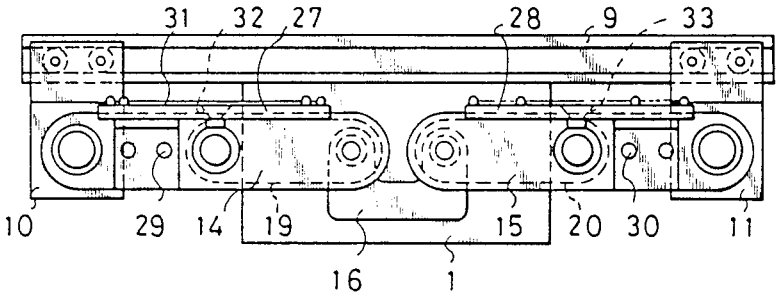
FIG. 5 is a front view of the embodiment shown in FIG. 4.
Figure 6:
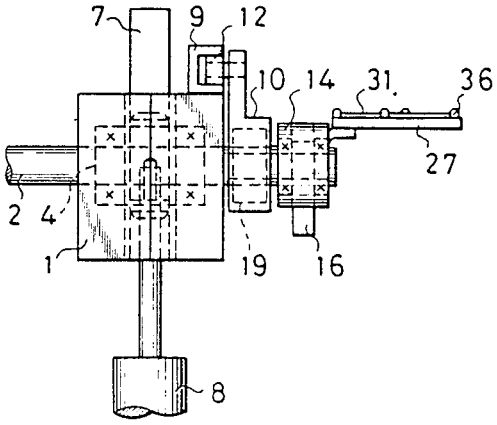
FIG. 6 is a side view of the embodiment shown in FIG. 4.

FIGS. 4 to 6 show the first embodiment of the invention equipped with turnover jigs 27, 28. The turnover jigs 27, 28 have a square frame-like shape and are secured into the recesses 23, 24 by means of screws 29, 30, respectively. A first suction retainer 32 and a second suction retainer 33 which retain a blank 31 through suction are mounted on the turnover jigs 27, 28 by means of holders 34, 35, respectively. Guide pins 36, 37 for positioning the blank 31 are retractably attached to the turnover jigs 27, 28, respectively.

Figure 7:
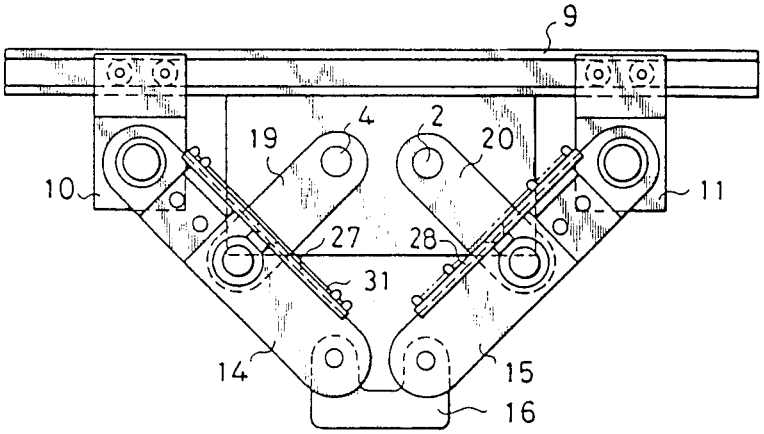
FIGS. 7 and 8 are front views of the embodiment shown in FIG. 4 in the state where it is in the course of a turnover operation.

The operation of the first embodiment of the invention will now be described. In an inoperative state, the links 19, 20 are at their respective horizontal positions shown in FIGS. 4 to 6. In consequence, the first and second pivoting arms 14, 15 are suspended at their respective horizontal positions on the mutual horizontal plane. When the arm of a handling device, not shown, takes out the blank 31 from the press and carries the same onto the turnover jig 27, the first suction retainer 32 is started through the control effected by a controller, not shown, to retain the blank 31. At the same time, the driving shaft 2 rotates clockwise as viewed in FIG. 5. In consequence, the driven shaft 4 rotates counterclockwise. Accordingly, as shown in FIG. 7, the links 19, 20 rotate in the directions opposite to each other to draw down the linked inner ends **14*b*, 15*b* of the first and second pivoting arms 14, 15, causing the first and second horizontally moving members 10, 11 to move inwardly. When the driving shaft 2 has rotated 90 degrees, the first and second pivoting arms 14, 15 reach their respective vertical positions shown in FIG. 8 where their upper sides come in contact with each other. Here, the clockwise rotation of the driving shaft 2** stops.

When the fact that the first and second pivoting arms 14, 15 have reached their respective vertical positions is senced by means of a sensor, such as a limit switch (not shown), the first suction retainer 32 releases the blank 31, and at the same time, the second suction retainer 33 retains the blank 31. In consequence, the blank 31 is transferred from the turnover jig 27 to the turnover jig 28.

Figure 8:
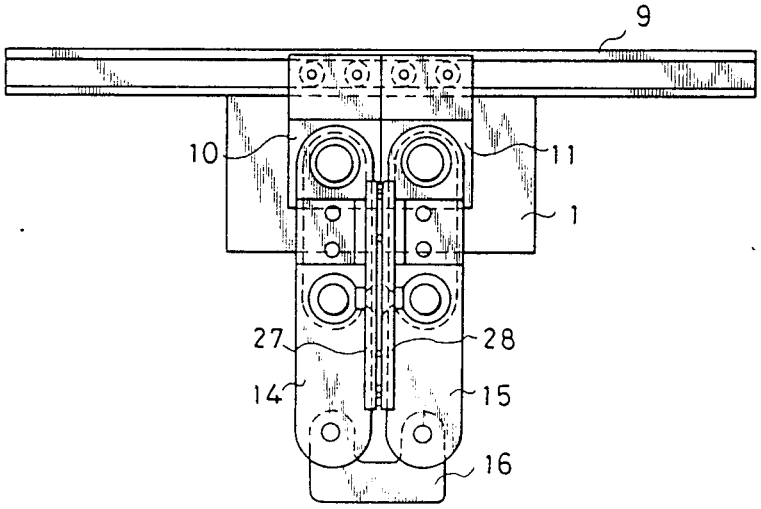

Since the driving shaft 2 rotates 90 degrees counterclockwise after the first and second pivoting arms 14, 15 have reached their respective vertical positions shown in FIG. 8, the first and second pivoting arms 14, 15 return to their respective horizontal positions shown in FIG. 5 through the positions shown in FIG. 7. As a result, the blank 31 stops at the position shown by a two-dot chain line in FIG. 5 in the state where it has been turned over 180 degrees. At this position, the second suction retainer 33 releases the blank 31.

According to this embodiment, each of the links 19, 20 and the first and second pivoting arms 14, 15 has a rotation angle of 90 degrees, which is a half of that in the conventional apparatus; therefore, it is possible to increase the turnover speed. In addition, since the turnover operation is effected below the guide rail 9, even if the turnover operation is started before the arm of the handling device has escaped from the upper side of the turnover jig 27, there is no possibility that the blank 31 may strike against the arm, thereby allowing a reduction in time for feeding the blank 31.

Although in this embodiment the first and second pivoting arms 14, 15 and the jigs 27, 28 are provided separately from each other, they may be integrated. The first and second horizontally moving members are not limited to those having the illustrated structure. For example, each of the first and second horizontally moving members may be constituted by a roller directly rotatably attached to each of the outer ends 14*a*, 15*a* of the pivoting arms 14, 15. In addition, the first and second suction retainers may be constituted by electromagnets, respectively, when the blank 31 is a magnetic material.

FIGS. 9 to 21 show a second embodiment of the invention. In the Figures, the parts similar to those in the first embodiment of the invention are denoted by the same reference numerals, respectively.

Figure 9:
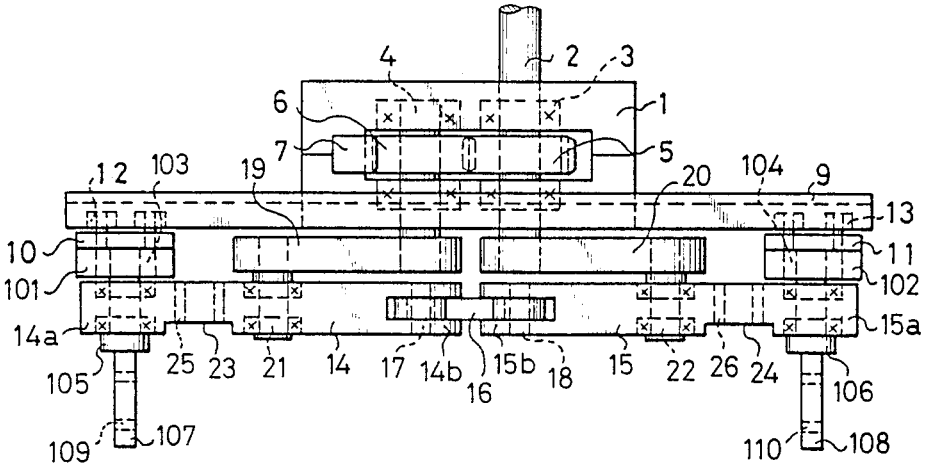
FIG. 9 is a plan view of a second embodiment of the invention in the state where jigs thereof are removed.
Figure 10:
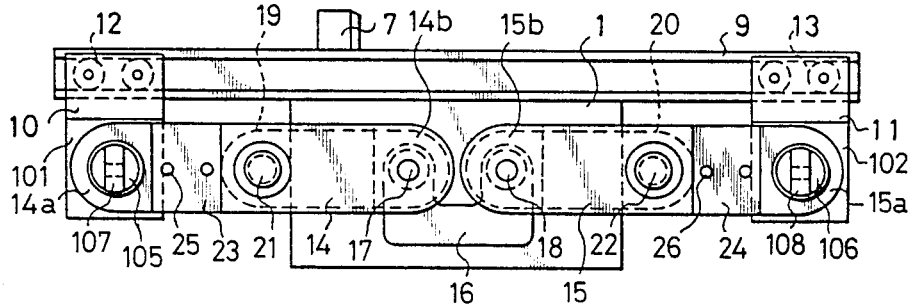
FIG. 10 is a front view of the embodiment shown in FIG. 9.
Figure 11:
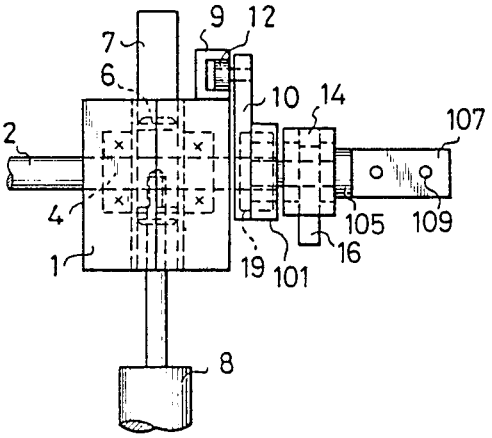
FIG. 11 is a side view of the embodiment shown in FIG. 9.

FIGS. 9 to 11 show the second embodiment of the invention in the state where turnover jigs or moving jigs for retaining a blank are removed. The body 1 is secured to the bolster or other member of a press. The driving shaft 2 connected to a power source, such as a crankshaft of the press, is rotatably supported by the bearing 3 inside the body 1 and has its rear end projected from the body 1. The driven shaft 4 is provided in parallel to the driving shaft 2. The driving force from the driving shaft 2 is transmitted to the driven shaft 4 through the gears 5, 6. The gear 6 is engaged with the rack gear 7, which is in turn connected to the rod of the air cylinder 8. The air cylinder 8 serves as a return spring.

The body 1 has the horizontal guide rail 9 secured thereto. The guide rail 9 has the first horizontally moving member 10 and the second horizontally moving member 11 mounted thereon through the rollers 12, 13, respectively. Thus, the first and second horizontally moving members 10, 11 are movably guided only in the horizontal direction. Brakes 101, 102 are secured to the first and second horizontally moving members 10, 11. The brakes 101, 102 come in frictional contact with brake drums 103, 104 incorporated therein, respectively. Pins 105, 106 are secured to the brake drums 103, 104, respectively. Thus, the pins 105, 106 are usually fixed to the first and second horizontally moving members 10, 11, respectively, against rotation. When a rotational force larger than a predetermined value is applied to the pins 105, 106 from the outside, however, a slippage occurs between the brakes 101, 102 and the brake drums 103, 104, causing the pins 105, 106 to rotate.

The pin 105 rotatably supports the outer end 14*a* of the first pivoting arm 14. Similarly, the pin 106 rotatably supports the outer end 15*a* of the second pivoting arm 15. The inner end 14*b* of the first pivoting arm 14 and the inner end 15*b* of the second pivoting arm 15 are rotatably linked through the link 16 and the pins 17, 18.

The inner ends of the links 19, 20 are secured to the ends of the driven shaft 4 and the driving shaft 2 forwardly projecting from the body 1, respectively. Further, the pins 21, 22 are secured to the outer ends of the links 19, 20, respectively. The pin 21 is rotatably connected to the central part of the first pivoting arm 14, while the pin 22 is rotatably connected to the central part of the second pivoting arm 15. The first and second pivoting arms 14, 15 are provided with the recesses 23, 24 for mounting the turnover jigs (described hereinafter), respectively. The recesses 23, 24 have the threaded holes 25, 26, respectively. The distal ends of the pins 105, 106 are adapted to serve as mounting portions 107, 108 for mounting moving jigs (described hereinafter) and therefore have threaded holes 109, 110, respectively (FIG. 9).

Figure 12:
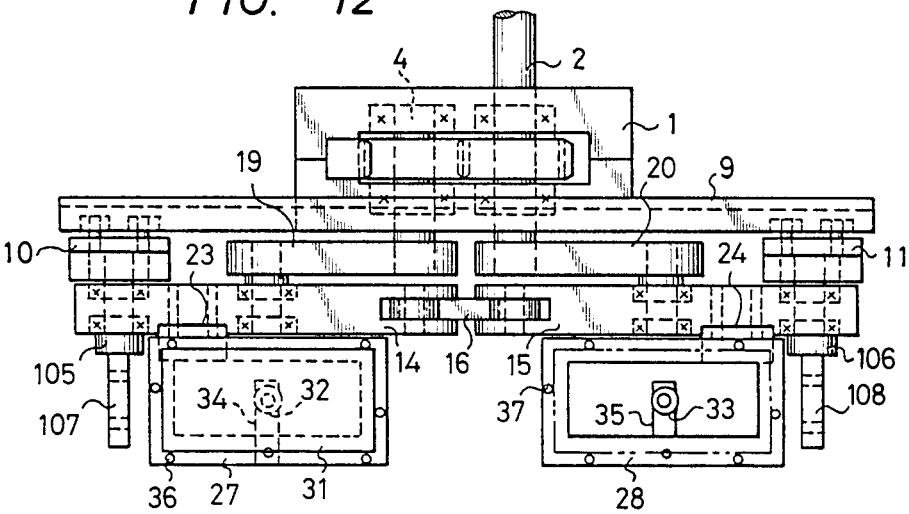
FIG. 12 is a plan view of the second embodiment of the invention in the state where moving jigs are mounted thereon.

FIG. 12 shows the second embodiment of the invention equipped with the turnover jigs 27, 28. The turnover jigs 27, 28 have a square frame-like shape and are secured into the recesses 23, 24 by means of the screws 29, 30 (see FIG. 14), respectively. The first suction retainer 32 and the second suction retainer 33 which retain the blank 31 through suction are mounted on the turnover jigs 27, 28 by means of the holders 34, 35, respectively. The guide pins 36, 37 for positioning the blank are retractably attached to the turnover jigs 27, 28, respectively.

Figure 13:
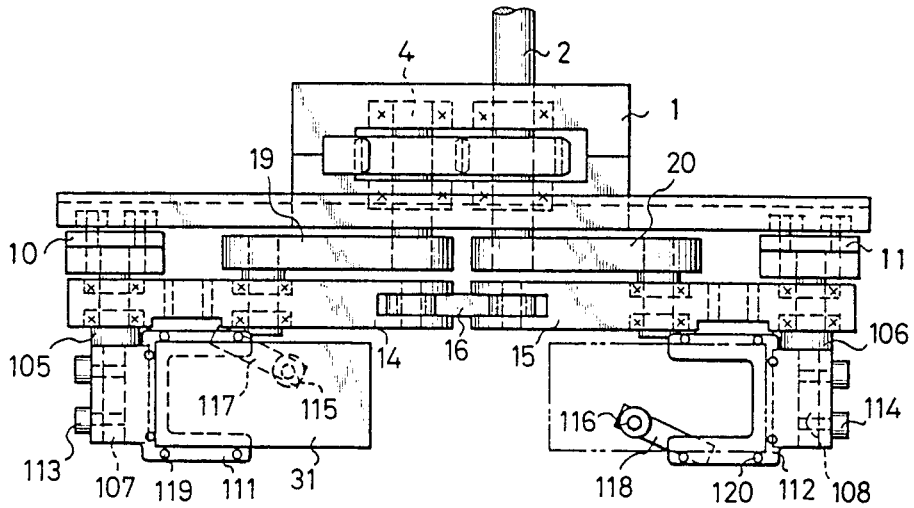
FIG. 13 is a plan view of the second embodiment of the invention in the state where moving jigs are mounted thereon.

FIG. 13 shows the second embodiment of the invention equipped with moving jigs 111, 112. The moving jigs 111, 112 have a U shape in plan and are secured to the mounting portions 107, 108 of the pins 105, 106 by means of screws 113, 114, respectively. Similarly to the turnover jigs 27, 28, the moving jigs 111, 112 have first and second suction retainers 115, 116, holders 117, 118 and guide pins 119, 120, respectively. The position of the blank 31 in its horizontal position is the same as in the case of the turnover jigs 27, 28.

Figure 14:
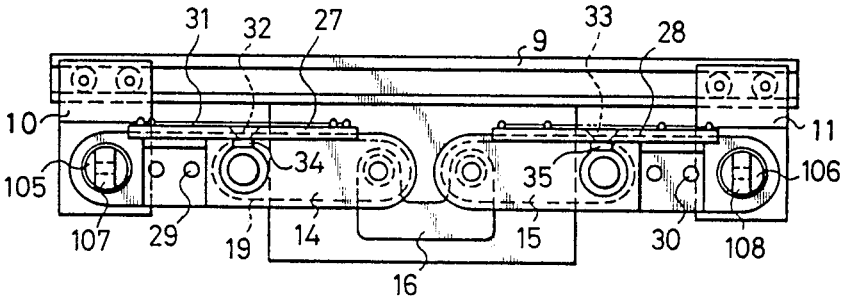
FIGS. 14 to 16 are front views of the second embodiment of the invention in different states in a turnover transfer operation, respectively.
Figure 15:
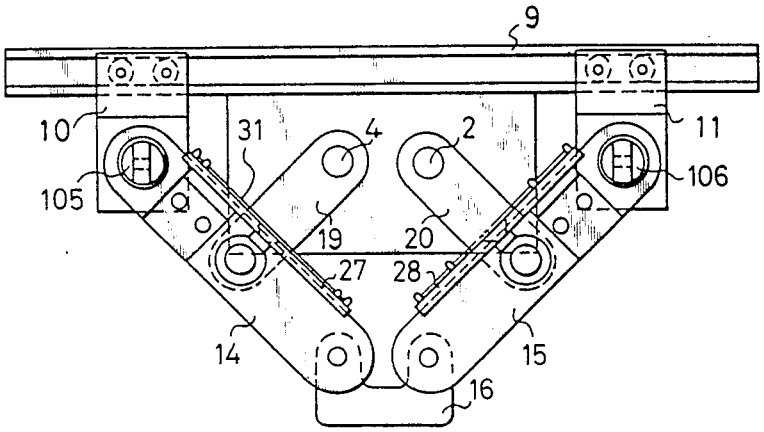
Figure 16:
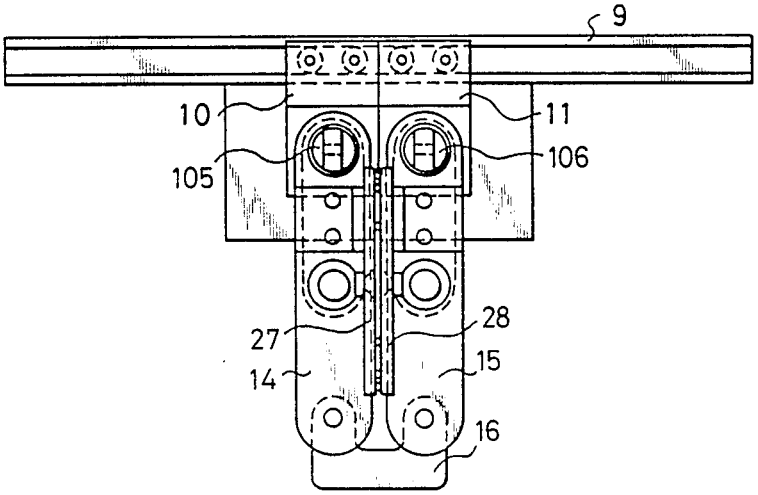

The turnover transfer operation in the second embodiment is effected in completely the same manner as that in the first embodiment as shown in FIGS. 14 to 16; hence, the description thereof is omitted.

The non-turnover transfer operation will be described hereinunder with reference to FIGS. 17 to 19. When the linked inner ends 14*b*, 15*b* of the first and second pivoting arms 14, 15 are drawn down by the clockwise rotation of the driving shaft 2 to cause the first and second horizontally moving members 10, 11 to move inwardly, the moving jigs 111, 112 horizontally move toward each other. When the driving shaft 2 has rotated a predetermined angle, about 80 degrees, the first and second pivoting arms 14, 15 reach their respective delivery positions shown in FIG. 19. As a result, the moving jigs 111, 112 approach each other to reach the state where the blank 31 is equally placed on the two moving jigs 111, 112. Here, the clockwise rotation of the driving shaft 2 stops.

When the fact that the moving jigs 111, 112 have reached their respective delivery positions is sensed by means of a sensor, such as a limit switch (not shown), the first suction retainer 115 releases the blank 31, and at the same time, the second suction retainer 116 retains the blank 31. As a result, the blank 31 is transferred from the moving jig 111 to the moving jig 112.

Figure 17:
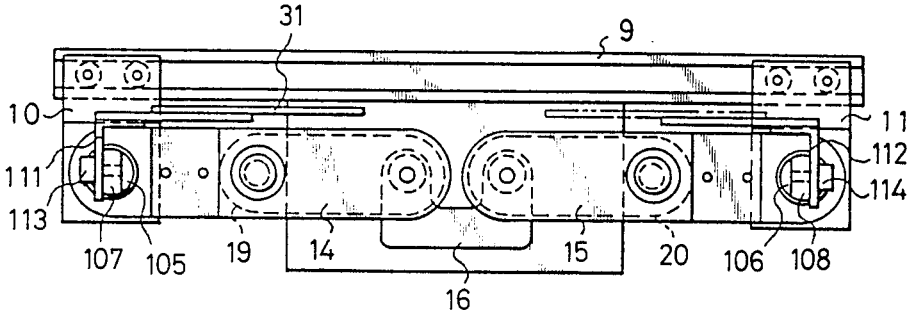
FIGS. 17 to 19 are front views of the second embodiment of the invention in different states in a non-turnover transfer operation, respectively.
Figure 18:
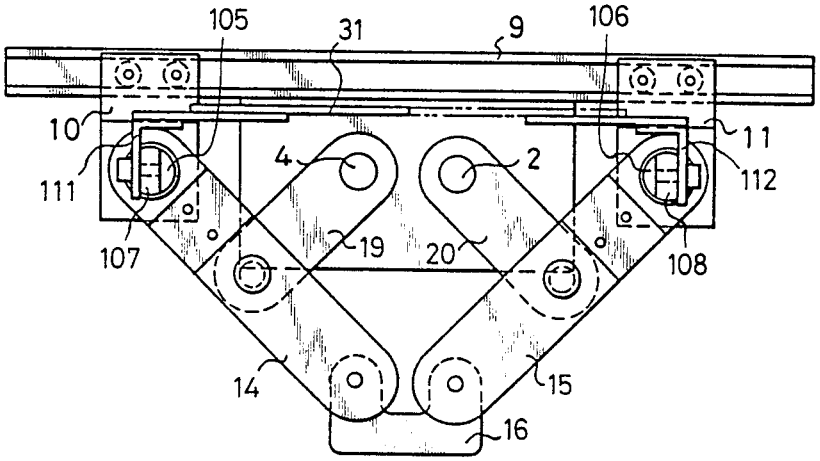
Figure 19:
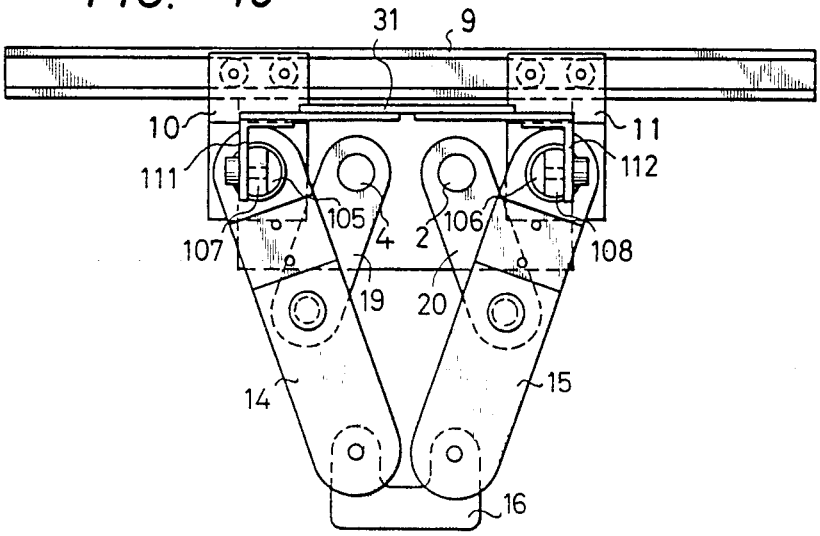

Since the driving shaft 2 reversely rotates after the first and second pivoting arms 14, 15 have reached their respective delivery positions shown in FIG. 19, the first and second pivoting arms 14, 15 return to their respective horizontal positions shown in FIG. 17. In consequence, the blank 31 stops at the position shown by two-dot chain line in FIG. 17. At this position, the second suction retainer 116 releases the blank 31. The distance of movement for this non-turnover transfer operation is equal to that for the turnover transfer operation shown in FIGS. 14 to 16.

Figure 20:
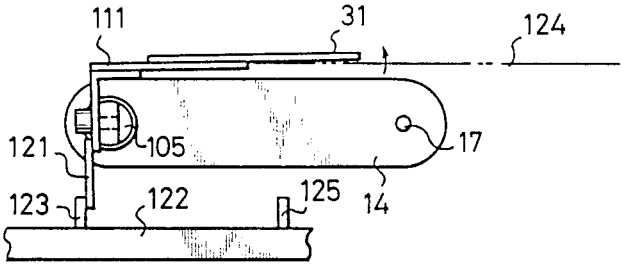
FIGS. 20 and 21 are front views of the second embodiment of the invention showing how a brake thereof works.

The brakes 101, 102 are adapted to work in the non-turnover transfer operation. Since the operations thereof are the same, the operation of the brake 101 will be explained hereinunder with reference to FIGS. 20 and 21. When the first pivoting arm 14 has returned to its horizontal position, a contact piece 121 attached to the moving jig 111 abuts on a stopper 123 secured to a supporting member 122 as shown in FIG. 20. In consequence, a counterclockwise rotational force larger than a predetermined value is applied to the pin 105 to rotate slightly in the counterclockwise direction. Accordingly, where the blank 31 is placed on the moving jig 111, the blank 31 is retained by the moving jig 111 slightly upward obliquely with respect to a horizontal moving line 124. It is thereby possible to eliminate the possibility that the forward end of the blank 31 may collide against the moving jig 112 at the delivery position.

Figure 21:
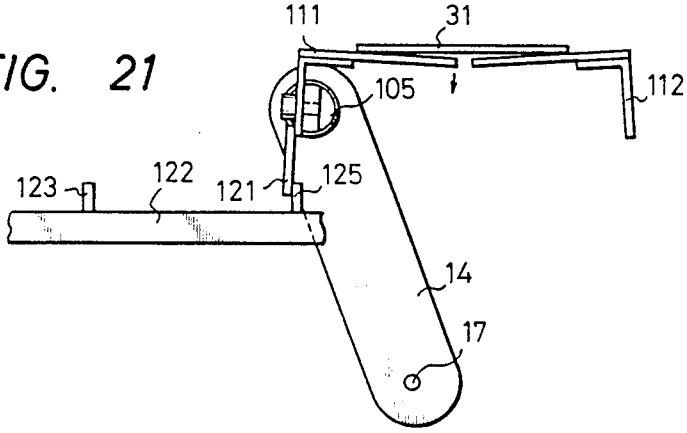

When the first pivoting arm 14 has pivoted to its delivery position shown in FIG. 21, the contact piece 121 abuts on another stopper 125. In consequence, a clockwise rotational force larger than a predetermined value is applied to the pin 105 to rotate slightly in the clockwise direction. As a result, the forward end of the blank 31 is lowered onto the moving jig 112.

According to this embodiment, it is possible to change over the turnover transfer operation and the non-turnover operation from one to the other simply by changing the turnover jigs 27, 28 and the moving jigs 111, 112 with each other. Therefore, the changeover operation is facilitated, and the time required for changeover can be reduced. In addition, the angle of rotation of each of the links 19, 20 and the first and second pivoting arms 14, 15 is 90 degrees at maximum; hence, the operating speed can be increased. Moreover, since the operation of each of the movable portions is effected below the guide rail 9, even if the operation is started before the arm of the handling device has escaped from the upper side of any movable portion, it will never strike against the arm. Accordingly, it is possible to reduce the time required for transferring the blank 31.

In this embodiment, the first and second suction retainers may be constituted by electromagnets, respectively, when the blank 31 is a magnetic material.

What is claimed is:

1. An apparatus for transferring a blank comprising:

a first blank-retaining member for retaining a blank before turnover;

a second blank-retaining member for receiving said blank from said first blank-retaining member, said second blank-retaining member having its inner end rotatably linked to the inner end of said first blank-retaining member;

first and second horizontally moving members adapted to be movable only in the horizontal direction and rotatably supporting the outer end of said first and second blank-retaining members, respectively;

a driving force transmitting means comprising a driving shaft;

a driven shaft disposed in parallel to said driving shaft and connected to said driving shaft through gears so as to rotate in the direction opposite to the direction of rotation of said driving shaft;

a first link having one end thereof secured to said driven shaft and the other end rotatably connected to the central part of either one of said blank-retaining members, and a second link having one end thereof secured to said driving shaft and the other end rotatably connected to the central part of the other blank-retaining member, wherein said driving force transmitting means maintains said first and second blank-retaining members in their respective horizontal positions in their inoperative states but draws down said linked inner ends of said first and second blank-retaining members in their operative states so that said first and second blank-retaining members come in contact with each other at their respective vertical positions and then returns said first and second blank-retaining members to their respective horizontal positions;

a first suction retainer which retains said blank on said first blank-retaining member from its horizontal position to its vertical position and releases said blank at the vertical position of said first blank-retaining member, said first suction retainer being mounted on said first blank-retaining member; and a second suction retainer which retains said blank on said second blank-retaining member from its vertical position to its horizontal position and releases said blank at the horizontal position of said second blank-retaining member, said second suction retainer being mounted on said second blank-retaining member.

2. An apparatus for transferring a blank according to claim 1, wherein each of said first and second blank-retaining members is constituted by a pivoting arm and a turnover jig detachably mounted on said pivoting arm.

3. An apparatus for transferring a blank according to claim 1, wherein each of said first and second horizontally moving members is equipped with at least one roller, which is adapted to roll on a horizontal guide rail.

4. An apparatus for transferring a blank according to claim 1, wherein each of said first and second horizontally moving members is constituted by one roller, which is adapted to roll on a horizontal guide rail.

5. An apparatus for transferring a blank according to claim 1, wherein said first and second suction retainers are constituted by vacuum retainers, respectively.

6. An apparatus for transferring a blank according to claim 2, wherein said first and second suction retainers are mounted on said turnover jigs, respectively.

7. An apparatus for transferring a blank according to claim 2, wherein said turnover jigs have a square frame-like shape.

8. An apparatus for transferring a blank according to claim 2, wherein at least one guide pin for positioning said blank is retractably provided on each of said turnover jigs.

9. An apparatus for transferring a blank comprising:

a first pivoting arm;

a second pivoting arm having its inner end rotatably linked to the inner end of said first pivoting arm;

first and second horizontally moving members adapted to be movable only in the horizontal direction and rotatably supporting the outer ends of said first and second pivoting arms, respectively;

two turnover jigs, one detachably mounted on said first pivoting arm, and one detachably mounted on said second pivoting arm;

two moving jigs, one detachably mounted on said first horizontally moving member, and one detachably mounted on said second horizontally moving member;

a suction retainer mounted on each of said jigs for retaining a blank on the corresponding jig through suction;

a driving force transmitting means comprising a driving shaft;

a driven shaft disposed in parallel to said driving shaft and connected to said driving shaft through gears so as to rotate in the direction opposite to the direction of rotation of said driving shaft;

a first link having one end thereof secured to said driven shaft and the other end rotatably connected to the central part of either one of said pivoting arms; and a second link having one end thereof secured to said driving shaft and the other end rotatably connected to the central part of the other pivoting arm, wherein said driving force transmitting means maintains said first and second pivoting arms at their respective horizontal positions in their inoperative states but draws down said linked inner ends of said first and second pivoting arms in their operative states to a delivery position where said blank is transferred from one of said jigs to the other jig and then returns said first and second pivoting arms to their respective horizontal positions.

10. An apparatus for transferring a blank according to claim 9, wherein each of said first and second horizontally moving members is equipped with a plurality of rollers, which are adapted to roll on a horizontal guide rail.

11. An apparatus for transferring a blank according to claim 9, wherein said suction retainer is constituted by a vacuum retainer.

12. An apparatus for transferring a blank according to claim 9, wherein each of said first and second horizontally moving members is provided thereon with a pin, which is formed at its distal end with a mounting portion for mounting the corresponding one of said moving jigs.

13. An apparatus for transferring a blank comprising:

a first pivoting arm;

a second pivoting arm having its inner end rotatably linked to the inner end of said first pivoting arm;

first and second horizontally moving members adapted to be movable only in the horizontal direction and rotatably supporting the outer ends of said first and second pivoting arms, respectively;

two turnover jigs, one detachably mounted on said first pivoting arm, and one detachably mounted on said second pivoting arm;

two moving jigs, one detachably mounted on said first horizontally moving member, and one detachably mounted on said second horizontally moving member, each of said first and second horizontally moving members provided thereon with a pin, which is formed at its distal end with a mounting portion for mounting the corresponding one of said moving jigs;

a brake and a brake drum which rotatably comes in frictional contact with said brake, and said brake and brake drum being incorporated in each of said first and second horizontally moving members;

pins secured to said brake drums, respectively;

contact pieces attached to said moving jigs, respectively;

stoppers disposed at positions where said stoppers abut on said contact pieces, respectively, when said horizontally moving members are remotest from each other and when they are closest to each other;

a suction retainer mounted on each of said jigs for retaining a blank on the corresponding jig through suction; and a driving force transmitting means which maintains said first and second pivoting arms at their respective horizontal positions in their inoperative states but draws down said linked inner ends of said first and second pivoting arms in their operative states to a delivery position where said blank is transferred from one of said jigs to the other jig and then returns said first and second pivoting arms to their respective horizontal positions.

* * * * *